US010989508B2

(12) United States Patent
Rodgers, Jr. et al.

(10) Patent No.: US 10,989,508 B2
(45) **Date of Patent: *Apr. 27, 2021**

(54) ILLUMINING PROJECTILE SYSTEM

(71) Applicants: Willard Thomas Rodgers, Jr., Palm Harbor, FL (US); Ryan Christopher Jones, Dunedin, FL (US)

(72) Inventors: Willard Thomas Rodgers, Jr., Palm Harbor, FL (US); Ryan Christopher Jones, Dunedin, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/186,497

(22) Filed: Nov. 10, 2018

(65) Prior Publication Data

US 2019/0195604 A1 Jun. 27, 2019

Related U.S. Application Data

(60) Provisional application No. 62/583,202, filed on Nov. 8, 2017.

(51) Int. Cl.
*F42B 12/42* (2006.01)
*F42B 12/40* (2006.01)

(52) U.S. Cl.
CPC ..... *F42B 12/42* (2013.01); *F42B 12/40* (2013.01)

(58) Field of Classification Search
CPC ..... F42B 12/382; F42B 12/36; F42B 12/42; F42B 12/40; F42B 5/02; F42B 8/02
USPC ..... 102/346, 216, 293, 430, 444, 513
See application file for complete search history.

(56) References Cited

U.S. PATENT DOCUMENTS

| | | | | |
|---|---|---|---|---|
| 3,810,426 | A * | 5/1974 | Baker | F42B 12/40 102/513 |
| 6,095,051 | A * | 8/2000 | Saxby | F42B 8/02 102/430 |
| 6,880,467 | B1 * | 4/2005 | Knapp | F42B 12/36 102/293 |
| 7,441,505 | B1 * | 10/2008 | Rodgers, Jr. | F42B 12/382 102/444 |
| 8,297,193 | B1 * | 10/2012 | Lawson | F42B 8/24 102/216 |
| 2010/0285721 | A1 * | 11/2010 | Ma | F42B 8/12 446/485 |
| 2015/0159846 | A1 * | 6/2015 | Hollinger | H05B 33/0806 362/183 |

* cited by examiner

*Primary Examiner* — Michael D David

(57) ABSTRACT

A case is formed of a side wall with a front and rear end having a base. A projectile is formed of a side wall with a front end having a shaped section and a rear end with a base. The projectile is positioned within the case with the rear end of the projectile spaced from the rear end of the case to form a rearward chamber. A firing assembly includes a charge within the rearward chamber and a firing means. An illumining assembly is positioned within the projectile and includes a source of illumination. An electrical assembly includes a printed circuit board, a sensor, a timer, a battery, a controller, and a receiver to illuminate the sources of illumination following igniting the charge to activate the sensor and passage of time as determined by the timer.

11 Claims, 4 Drawing Sheets

ILLUMINING PROJECTILE SYSTEM

RELATED APPLICATION

The present invention is based upon and claims the benefit of Provisional Application No. 62/583,202 filed Nov. 8, 2017, entitled "Illumining Projectile System", which is based upon U.S. patent application Ser. No. 11/347,503 filed Feb. 3, 2006, now U.S. Pat. No. 7,441,505, the subject matter of which applications are incorporated herein by reference in their entirety.

BACKGROUND OF THE INVENTION

Field of the Invention

The present invention relates to an illumining projectile system and more particularly pertains to a projectile which is launched from a distance for illuminating a structure or personnel training area following a controlled time delay. The launching and the illuminating are done in a safe, convenient, and reliable manner.

Description of the Prior Art

The use of lighting systems of known designs and configurations is known in the prior art. More specifically, lighting systems of known designs and configurations previously devised and utilized for the purpose of providing illumination through known methods and apparatuses are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe an illumining projectile system that allows for launching a projectile from a distance for illuminating a structure or training area following a controlled time delay. The launching and the illuminating are done in a safe, convenient, and reliable manner.

In this respect, the illumining projectile system according to the present invention substantially departs from the conventional concepts and designs of the prior art, and in doing so provides an apparatus primarily developed for the purpose of illuminating a structure or personnel training area from a distance following a controlled time delay. The illuminating from a distance is done in a safe, convenient, and reliable manner.

Therefore, it can be appreciated that there exists a continuing need for a new and improved illumining projectile system which can be used for launching an illumining projectile from a distance to illuminate a structure or personnel training area following a controlled time delay. The illumining projectile system provides law enforcement, military, and other defense agencies a valuable tactical munition which is intended for use in hazardous situations or during personnel training exercises. In this regard, the present invention substantially fulfills this need.

SUMMARY OF THE INVENTION

In view of the foregoing disadvantages inherent in the known types of lighting systems of known designs and configurations now present in the prior art, the present invention provides an improved illumining projectile system. As such, the general purpose of the present invention, which will be described subsequently in greater detail, is to provide a new and improved illumining projectile system and method which has all the advantages of the prior art and none of the disadvantages.

To attain this, from a broad perspective, the present invention essentially comprises an illumining projectile system. First provided is a hollow case. The hollow case is formed of a cylindrical side wall. The hollow case has a rear end and a front end. The rear end has a circular base formed integrally with the cylindrical side wall. The front end has an opening with an inwardly extending radial flange. The hollow case is fabricated of a rigid material selected from the class of rigid materials including steel, aluminum, beryllium, plastic, or other rigid synthetic materials that resist flexing.

A projectile assembly is provided next. The projectile assembly includes a hollow projectile formed of a cylindrical side wall. The projectile has a rear end and a front end. The rear end has a circular base coupled with the side wall. The front end has a frusto-conical shaped section extending forwardly from the side wall and terminating in a concave area. The concave area is formed with a recessed cavity. A forward chamber is formed within the hollow projectile between the front end and the side wall and the circular base. The projectile assembly further includes an impact dome. The impact dome is provided in the concave area of the front end. The projectile assembly is positionable within the case with the rear end of the hollow projectile spaced from the rear end of the case. In this manner a rearward chamber is formed. The projectile is fabricated of a transparent rigid material selected from the class of transparent rigid materials including plastic, polycarbonate, or other rigid thermoplastic polymers.

Provided next is a hollow sabot. The sabot is formed of a cylindrical side wall. The sabot has a rear end and a front end. The rear end has a circular base formed integrally with the side wall. The front end has an opening with a leading edge. The leading edge is in contact with the radial flange of the case. The side wall and base of the sabot have an interior. The interior is in contact with the side wall and base of the hollow projectile. The side wall of the sabot has an exterior. The exterior is in contact with the side wall of the case. The sabot is fabricated of a frangible material selected from the class of frangible materials including paper, cardboard, plastic, or other foam based materials.

Next, a firing assembly is provided. The firing assembly includes an explosive propellant charge. The explosive propellant charge is provided in the rearward chamber in contact with the base of the case. The firing assembly also includes a firing means and a plastic support. The firing means activates a primer (not shown) which is located at the base of the case in contact with the propellant charge. The plastic support is provided within the rearward chamber to contact and support the explosive propellant charge. An air space is in the rearward chamber between the base of the sabot and the explosive propellant charge.

Further provided is an illumining assembly. The illumining assembly is positionable within the forward chamber. The illumining assembly is formed of an equilateral rear end and an equilateral front end. Illumining side walls are formed integrally of the front end and rear end. The illumining assembly includes sources of illumination positioned along the illumining side walls. The illumining assembly further includes electrical leads. The electrical leads extend inwardly from the sources.

Provided last is an electrical assembly. The electrical assembly includes a printed circuit board, a sensor, a timer, a battery, and a controller. The movements caused when firing the projectile from the case activates the sensor which activates the controller to illuminate the sources of illumination following a passage of time as determined by the timer. Alternatively, the movements can be simulated manually by striking the projectile against a rigid surface to activate the sensor and the controller to illuminate the sources of illumination. In alternate embodiments of the invention, the electrical assembly further includes a radio frequency receiver adapted to receive commands from a remote wireless transmitter to override the controller for activating and deactivating the sources of illumination. The radio frequency receiver provides for the illumining projectile system to be used multiple times, specifically for military training purposes.

There has thus been outlined, rather broadly, the more important features of the invention in order that the detailed description thereof that follows may be better understood and in order that the present contribution to the art may be appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved illumining projectile system which has all the advantages of the prior lighting systems of known designs and configurations and none of the disadvantages.

It is another object of the present invention to provide a new and improved illumining projectile system which may be easily and efficiently manufactured and marketed.

It is a further object of the present invention to provide a new and improved illumining projectile system which is reusable and of durable and reliable constructions.

An even further object of the present invention is to provide a new and improved illumining projectile system which is susceptible of a low cost of manufacture with regard to both materials and labor, and which accordingly is then susceptible of low prices of sale, thereby making such illumining projectile system economically available.

Even still another object of the present invention is to provide an illumining projectile system for illuminating a personnel training area from a distance in a safe and reliable manner.

Lastly, it is an object of the present invention to provide a new and improved illumining projectile system. A hollow case is formed of a side wall with a front and rear end. The case has a base. A projectile assembly includes a hollow projectile formed of a side wall with a front and rear end. The projectile assembly has a base and an impact dome positioned in the front end. The projectile assembly is positioned within the case. The rear end of the projectile is spaced from the rear end of the case to form a rearward chamber. A firing assembly includes a charge within the rearward chamber and a firing means. An illumining assembly includes a source of illumination. An electrical assembly includes a sensor and a controller and a timer. In this manner the source of illumination may be illuminated following igniting the charge and activating the electrical assembly.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
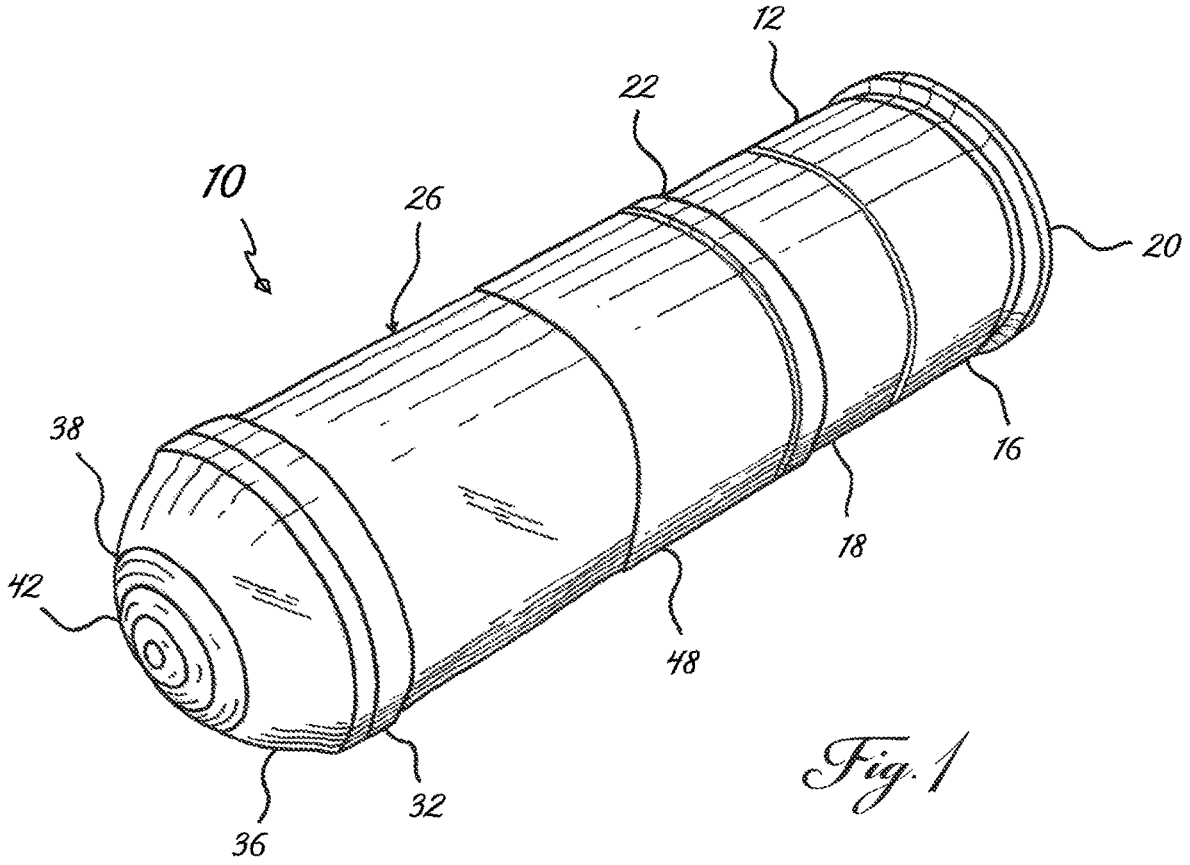
FIG. 1 is a perspective illustration of the illumining projectile system constructed in accordance with the principles of the present invention.
Figure 2:
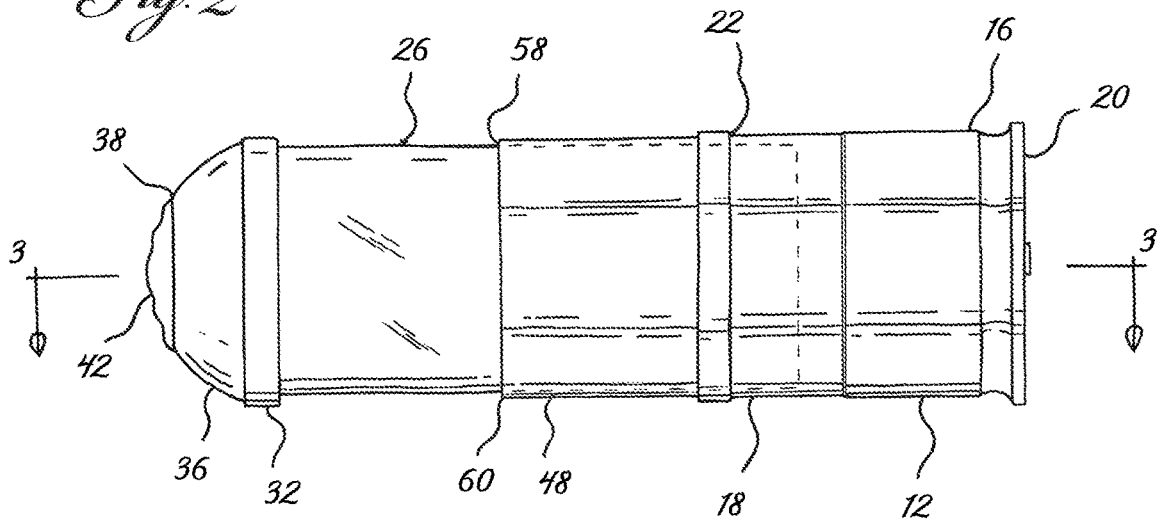
FIG. 2 is a side elevational view of the illumining projectile system.
Figure 3:
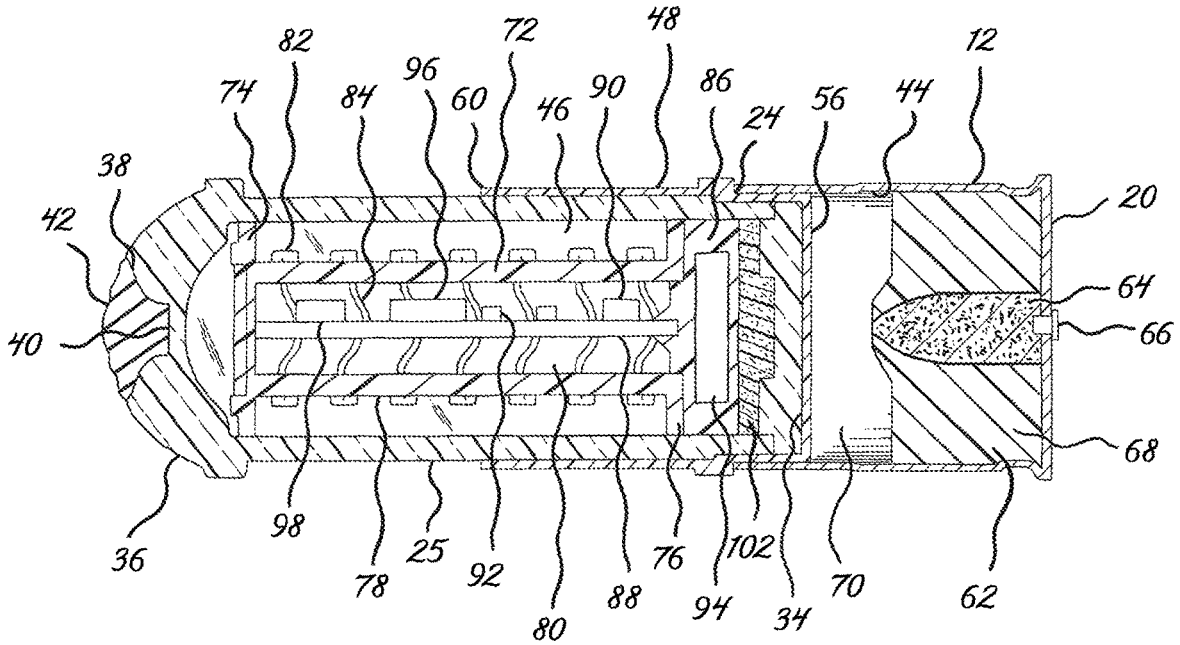
FIG. 3 is a cross sectional view taken along line 3-3 of FIG. 2.
Figure 4:
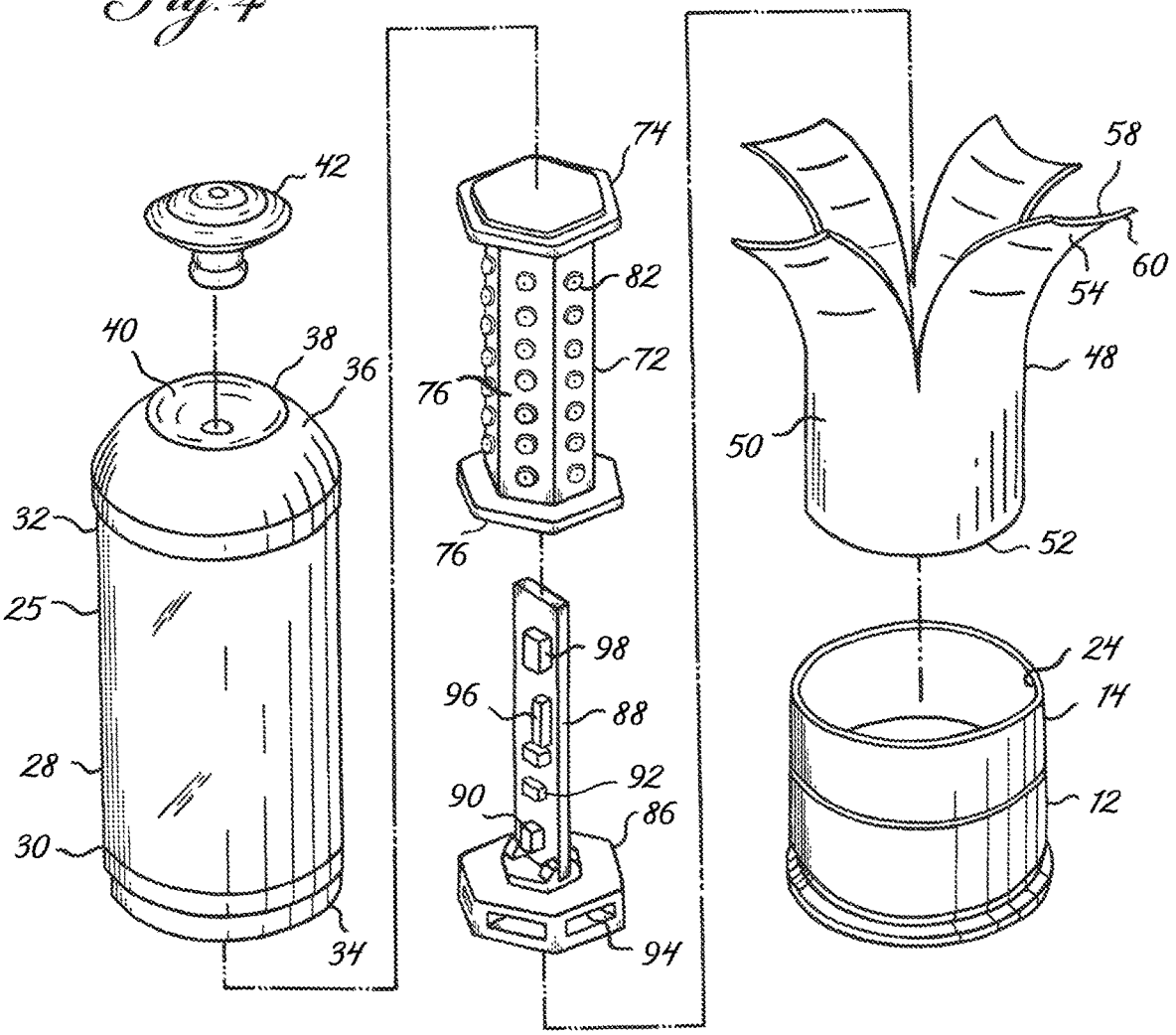
FIG. 4 is an exploded perspective illustration of the illumining projectile system shown in FIGS. 1 through 3.

With reference now to the drawings, and in particular to FIG. 1 thereof, the preferred embodiment of the new and improved illumining projectile system embodying the principles and concepts of the present invention and generally designated by the reference numeral 10 will be described.

The present invention, the illumining projectile system 10 is comprised of a plurality of components. In their broadest context such include a case, a projectile assembly, a firing assembly, an illumining assembly, and an electrical assembly. Such components are individually configured and correlated with respect to each other so as to attain the desired objective.

In the preferred embodiment of the illumining projectile system 10, first provided is a hollow case 12. The case is formed of a cylindrical side wall 14. The case has a rear end 16 and a front end 18. The rear end has a circular base 20. The circular base is formed integrally with the side wall. The front end has an opening 22. The opening has an inwardly extending radial flange 24. The case is fabricated of a rigid material selected from the class of rigid materials including steel, aluminum, beryllium, plastic or other rigid synthetic materials that resist flexing.

A projectile assembly 25 is provided next. The projectile assembly includes a hollow projectile 26 formed of a cylindrical side wall 28. One skilled in the art would recognize that the cylindrical side wall could be any geometric cylindrical configuration. The projectile has a rear end 30 and a front end 32. The rear end has a circular base 34 coupled to the side wall. The front end has a generally frusto-conical shaped section 36. The shaped section extends forwardly from the side wall and terminates in a forward concave area 38. The concave area has a recessed cavity 40.

The projectile assembly includes an impact dome 42. The impact dome is provided in the concave area of the projectile. The projectile assembly is positioned within the case. The rear end of the projectile is spaced from the rear end of the case. In this manner a rearward chamber 44 is formed. A forward chamber 46 is formed within the front end, side wall, and circular base of the hollow projectile.

The hollow projectile is fabricated of a transparent rigid material selected from the class of transparent rigid materials including plastic, polycarbonate, or other rigid thermoplastic polymers. The impact dome is fabricated of resilient elastomeric materials selected from the class of elastomeric materials including silicone, rubber, vinyl, or other elastically resilient materials.

Provided next is a hollow sabot 48. The sabot is formed of a cylindrical side wall 50. The sabot has a rear end 52 and a front end 54. The rear end has a circular base 56 formed integrally with the side wall. The front end has an opening 58 with a leading edge 60. The side wall and base of the sabot have an interior. The interior is in contact with the side wall and base of the hollow projectile. The side wall of the sabot has an exterior. The exterior is in contact with the side wall of the case. The sabot is fabricated of a frangible material selected from the class of frangible materials including paper, cardboard, plastic, or other foam based materials.

A firing assembly 62 is provided. The firing assembly includes an explosive propellant charge 64. The explosive propellant charge is provided in the rearward chamber in contact with the base of the case. The firing assembly also includes a firing means 66. The firing means activates a primer (not shown) which is located at the base of the case in contact with the explosive propellant charge. The firing assembly further includes a plastic support 68. The plastic support is provided within the rearward chamber to contact and support the explosive propellant charge. An air space 70 is in the rearward chamber between the base of the sabot and the explosive propellant charge. One skilled in the art would recognize that the firing means may be any device that would activate the primer, such as an elected charge or current, firing pin, striker, or hammer.

Further provided is an illumining assembly 72. The illumining assembly is positioned within the forward chamber. The illumining assembly has a front end 74 and a rear end 76. Illumining side walls 78 are formed integrally of the front and rear end. A hollow compartment 80 is formed within the illumining side walls. The illumining assembly includes sources of illumination or light emitting diodes 82 positioned along the illumining side walls. The illumining assembly further includes electrical leads 84. The electrical leads extend from the sources of illumination to and through the illumining side walls.

Provided last is an electrical assembly 86. The electrical assembly includes a printed circuit board 88, a sensor 90, a timer 92, a battery 94, and a controller 96. The sensor activates the controller when movements are detected from the projectile being fired from the case to illuminate the sources of illumination following a passage of time as determined by the timer. The controller is configured to regulate the illuminating pattern and activation sequence of the sources illumination.

In alternate embodiments of the invention, the electrical assembly further includes a radio frequency receiver 98. The radio frequency receiver is configured to detect transmitted radio signals sent remotely from a corresponding device for overriding the controller to activate or deactivate the sources of illumination. One skilled in the art would recognize that the electrical assembly components may be hardened or receive a resilient coating while being positioned in the hollow projectile to withstand the forces generated when fired from the case to maintain functionality.

In an alternate embodiment of the invention, the sources of illumination provide light. The light is selected from the class of lights including ultraviolet light, infrared light, thermal, and visible light.

In another alternate embodiment of the invention, the circular base of the projectile is made of buoyant materials for allowing buoyancy when projected into a large body of fluids such as oceans or lakes for illumining, marking, and identifying areas from aerial distances.

Figure 5:
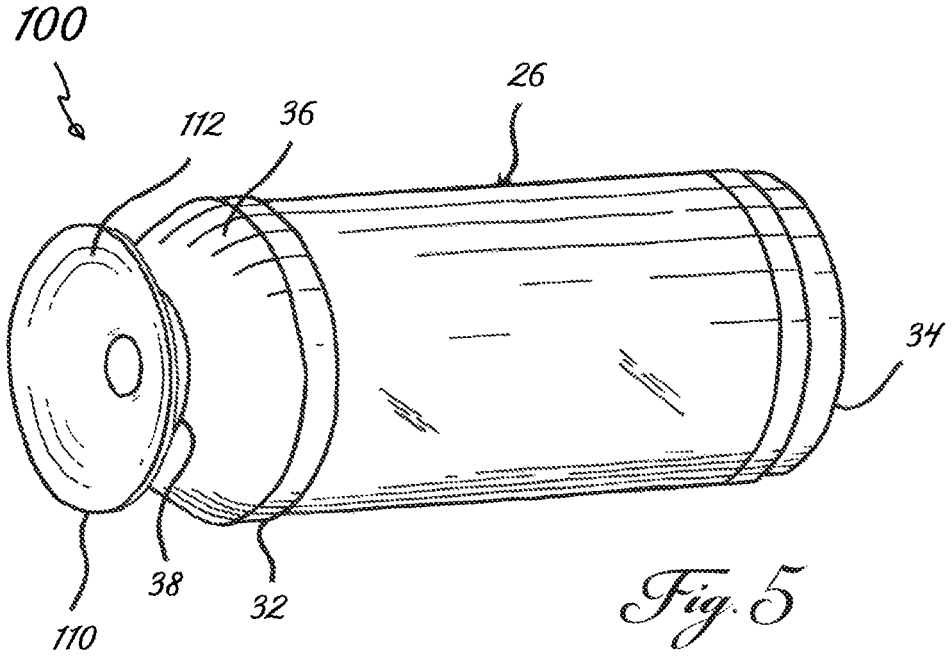
FIG. 5 is a perspective illustration of a projectile constructed in accordance with a first alternate embodiment of the invention.
Figure 6:
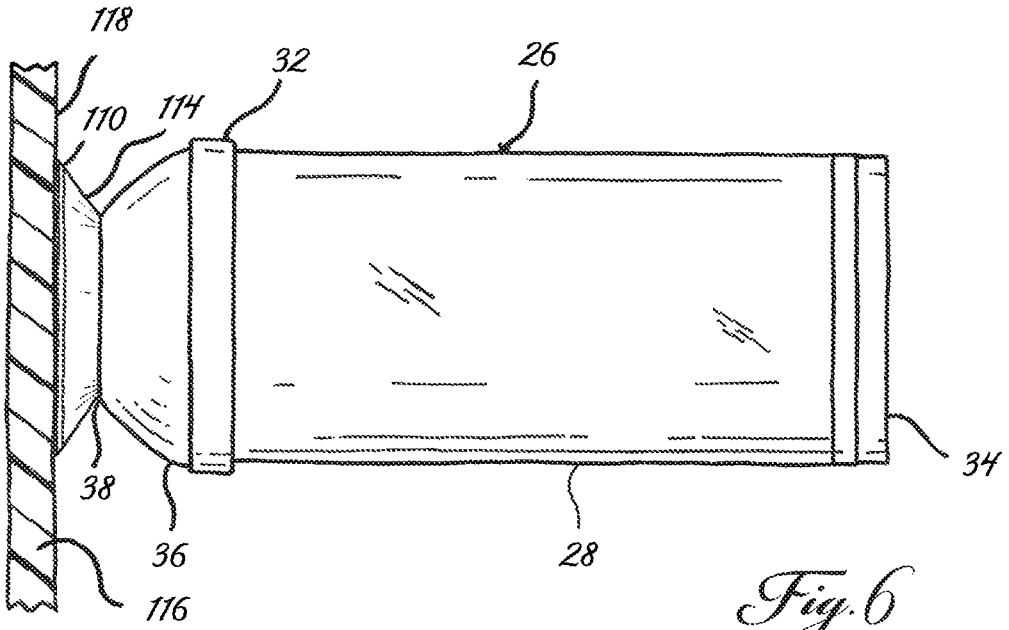
FIG. 6 is a side elevational view of a projectile with the first alternate embodiment of the invention.

Another alternate embodiment of the invention is illustrated in FIGS. 5 and 6. In this embodiment, a impact suction cup 110 is provided. The impact suction cup is positioned in the forward concave area of the hollow projectile. The generally arcuate suction cup has an inner surface and an outer surface. The inner surface is formed of a concave face 112. The outer surface is formed of a convex face 114. The impact suction cup is fabricated of resilient elastomeric materials selected from the class of elastomeric materials including silicone, rubber, vinyl, and other elastically resilient materials. Illustrated in FIG. 6, when the concave face makes contact with a smooth material 116 such as glass, plastic, metal, or other like materials, the projectile assembly will temporarily adhere to the smooth surface 118 for illumining purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illumining projectile system comprising:

a case formed of a side wall with a front and rear end having a base;

a projectile formed of a side wall with a front end having a shaped section and a rear end with a base, the projectile being positioned within the case with the rear end of the projectile spaced from the rear end of the case to form a rearward chamber;

a firing assembly including a charge within the rearward chamber and a firing means;

an illumining assembly within the projectile having sources of illumination; and an electrical assembly including a printed circuit board and a sensor and a timer and a battery and a controller to illuminate the sources of illumination following igniting the charge to activate the sensor and passage of time as determined by the timer.

2. The system as set forth in claim 1 and further including:

a sabot formed of a side wall with a front and rear end with a base, the side wall and base of the sabot having an interior in contact with the side wall and base of the projectile, the side wall of the sabot having an exterior in contact with the side wall of the case.

3. The system as set forth in claim 1 wherein the sources of illumination provides light selected from the class of lights including ultraviolet light, infrared light, thermal light and visible light.

4. The system as set forth in claim 1 wherein the sensor activates the controller when the projectile is fired from the hollow case to illuminate the sources of illumination following a passage of time as determined by the timer.

5. The system as set forth in claim 1 and further including:

the electrical assembly having a radio frequency receiver configured for activating and deactivating the sources of illumination from a distance by receiving commands from a corresponding wireless transmitter device.

6. The system as set forth in claim 1 wherein the front shaped section of the projectile is formed with a concave section for receiving an impact dome, the impact dome being made of resilient elastomeric materials and intended for reducing hazardous impacts when contacting target objects.

7. The system as set forth in claim 6 wherein the impact dome is in the form of an impact suction cup (110), the impact suction cup being made of resilient elastomeric materials and intended for temporarily adhering the projectile to smooth surfaces for illumining purposes.

8. The system as set forth in claim 1 wherein the base of the projectile is made of buoyant materials for enabling buoyancy when projected into a large body of fluids for illumining and identifying areas from aerial distances.

9. An illumining projectile system for illuminating a distant structure or personnel training area following a controlled time delay, the system comprising:

a hollow case (12) is formed of a cylindrical side wall (14) with a rear end (16) and a front end (18), the rear end having a circular base (20) formed integrally with the side wall, the front end having an opening (22) with an inwardly extending radial flange (24), the hollow case being fabricated of a rigid material selected from the class of rigid materials including steel, aluminum, beryllium, plastic, or other rigid synthetic materials which resist flexing;

a projectile assembly (25) including a hollow projectile (26) formed of a cylindrical side wall (28) with a rear end (30) and a front end (32), the rear end having a circular base (34) coupled to the side wall, the front end having a generally the sabot having an exterior in contact with the side wall of the case, the sabot being fabricated of a frangible material selected from the class of frangible materials including paper, cardboard and plastic;

a firing assembly (62) including an explosive propellant charge (64) within the rearward chamber in contact with the base of the case and also including a firing means (66) extending through the base of the hollow case in contact with the explosive propellant charge, a plastic support (68) within the rearward chamber to contact and support the explosive propellant charge with an air space (70) in the rearward chamber between the base of the hollow sabot and the explosive propellant charge;

an illumining assembly (72) positionable within the forward chamber, the illumining assembly having a front end (74) and a rear end (76), illumining side walls (78) formed integrally of the front and rear end, the illumining assembly including sources of illumination (82) with electrical leads (84) extending from the sources to and through the illumining side walls; and an electrical assembly (86) including a printed circuit board (88), a sensor (90), a timer (92), a source of power (94), and a controller (96), the sensor being adapted to detect when frusto-conical shaped section (36) extending forwardly from the side wall and terminating in a concave area (38) formed with a recessed cavity (40), a forward chamber (46) is formed within the hollow projectile between the front end, side wall, and circular base, the hollow projectile being fabricated of a transparent rigid material selected from the class of transparent rigid materials including plastic, polycarbonate, or other rigid thermoplastic polymers;

an impact dome (42) is provided in the concave area of the hollow projectile, the impact dome being fabricated of a resilient elastomeric material selected from the class of elastomeric materials including silicone, rubber, vinyl, or other elastically resilient materials;

the projectile assembly being positionable within the hollow case with the rear end of the hollow projectile spaced from the rear end of the case to form a rearward chamber (44);

a hollow sabot (48) formed of a cylindrical side wall (50) with a rear end (52) and a front end (54), the rear end having a circular base (56) formed integrally with the side wall, the front end having an opening (58) with a leading edge (60) in contact with the radial flange of the hollow case, the side wall and base of the sabot having an interior in contact with the side wall and base of the hollow projectile, the side wall of the projectile assembly is fired from the case which activates the controller to illuminate the sources of illumination following a passage of time as determined by the timer.

10. The system as set forth in claim 9 wherein the electrical assembly comprises a radio frequency receiver (98) configured to receive commands from a remote wireless transmitter for manually overriding the controller to activate and deactivate the sources of illumination from a distance.

11. The system as set forth in claim 9 wherein the base of the projectile is made of buoyant materials for enabling buoyancy when projected into a large body of fluids for illumining and identifying areas from aerial distances.

* * * * *